US005794260A

United States Patent [19]

Schegerin

[11] Patent Number: 5,794,260

[45] Date of Patent: Aug. 18, 1998

[54] HEAD PROTECTION SYSTEM WITH REGULATED PRESSURE AREAS

[76] Inventor: Robert Schegerin, 4 Chemin Due Vallot, 78350 Jouy En Josas, France

[21] Appl. No.: 769,136

[22] Filed: Dec. 18, 1996

[30] Foreign Application Priority Data

Dec. 21, 1995 [FR] France ..... 95 15233

[51] Int. Cl.[6] ..... A42B 3/00

[52] U.S. Cl. ..... 2/6.1; 2/410; 2/424; 128/202.4

[58] Field of Search ..... 2/6.1, 6.2, 6.3, 2/410, 411, 422, 424; 128/202.4, 201.22, 201.23, 201.24, 206.24

[56] References Cited

U.S. PATENT DOCUMENTS

| | | | |
|---|---|---|---|
| 4,250,877 | 2/1981 | Owens et al. | 128/201.23 |
| 4,676,236 | 6/1987 | Piorkowski et al. | 128/201.23 |

FOREIGN PATENT DOCUMENTS

| | | |
|---|---|---|
| 0371858 | 6/1990 | European Pat. Off. . |
| 1265565 | 10/1961 | France . |
| 1568686 | 4/1969 | France . |
| 2375873 | 7/1978 | France . |
| 1587812 | 4/1981 | United Kingdom . |
| 2074457 | 11/1981 | United Kingdom . |

*Primary Examiner*—Gloria M. Hale
*Attorney, Agent, or Firm*—Larson & Taylor

[57] ABSTRACT

A head protection system providing several types of head protection comprised of at least three cavities called C1, C2, C3, defining three volumes V1, V2, V3 wherein:

C1 is a cavity defined by a mask M for including the mouth and the nose of the wearer.

C2 is a cavity defined by the front face of the head component for including at least the eyes of the wearer.

C3 is a cavity defined by the rest of the head protection system and for including a large part of the hair of the wearer.

Three seals J1, J, J3 insulate the three cavities C1, C2 and C3. These three seals are continuous and close up on themselves.

The seal J1 insulates the cavity C1 from the cavity C2, the seal J2 insulates the cavity C2 from the cavity C3, the seal J3 insulates the cavity C3 from the ambient atmosphere.

16 Claims, 4 Drawing Sheets

| PA | P1 | P2 | P3 |
|---|---|---|---|
| 5 | 4,5 | 4 | 3 |
| 10 | 9 | 5 | 3 |
| 20 | 19 | 10 | 3 |
| 40 | 38 | 23 | 3 |
| 60 | 57 | 25 | 4 |
| 80 | 76 | 33 | 4 |
| 100 | 95 | 43 | 4 |
| 150 | 145 | 70 | 5 |

FIG. 4

HEAD PROTECTION SYSTEM WITH REGULATED PRESSURE AREAS

BACKGROUND OF THE INVENTION

1. Field of the Invention

The present invention related to pressurized masks which provide a seal in a contaminated or low oxygen atmosphere.

Nowadays, head protection systems need to be more and more efficient. They often have to be impervious to contaminated products in the atmosphere and to maintain high inner pressures particularly for aeronautical applications. Many products exist to ensure certain physiologic protections, but few examples exist wherein it is possible to combine several efficient physiologic protections in one system.

The present main difficulty is to conceive of, and to integrate a flexible mask capable of accepting over-pressures (superior to 100 hectoPascal) without leaking. Indeed, when a high pressure has to be kept in the mask, it is necessary to maintain the mask strongly on the wearer's face. This induces a bloating of the cheek, which is detrimental to the performance of the seal, which thus starts leaking.

On the other hand, each face is very different and experience shows that the difficulty to seal a mask increases in an exponential manner when the pressure in the mask increases. As a matter of fact, it is relatively easy to seal a mask for a pressure from 30 to 60 hectoPascal, difficult to seal for a pressure from 60 to 90 hectoPascal and in actual fact impossible to seal a mask for inner pressures between 120 and 150 hectoPascal. The invention here proposed resolves this problem.

2. Description of the Prior Art

French patent No.76 39 294 from 1976 proposes several solutions allowing independent pressurization of the ears and eyes. It is not proposed to integrate a mask in the visor part and thus to improve the behavior of the mask seal by reducing the differential pressure existing on each side of the seal and by pulling the cheek skin to improve the sealing between the mask lip and the cheek skin. Rather, it has been proposed to place an inflatable seal in the mask. Unfortunately, once inflated, the seal is very stiff and cannot fit the complex three dimensional shape of the face, so the results are bad.

One of the goals of invention is to create a head protection system permitting physiological head protection in a contaminated atmosphere and/or at a low oxygen concentration.

The pressures expressed in hectoPascal are differential pressures between the absolute pressure of the considered area and the absolute ambient atmospheric pressure.

The pressures expressed in bars are absolute pressures. One goal of the invention is to realize a light and cheap head protection system allowing physiological head protection in a contaminated atmosphere and/or at a low oxygen concentration.

SUMMARY OF THE INVENTION

These goals are reached by the process according to the invention which is mainly characterized by the fact that there is a head protection system including at least three cavities called C1, C2, and C3 defining three volumes V1, V2, V3 wherein:

C1 is a cavity defined by the mask M for including the mouth and the nose of the wearer;

C2 is a cavity defined by the front face of the head protection system for including at least the eyes of the wearer;

C3 is a cavity defined by the rest of the head protection system for including a large part of the hair of the wearer; and wherein three seals J1, J2, J3 insulate the three cavities C1, C2, C3;

these three seals are continuous and close up on themselves.

the seal J1 insulates the cavity C1 from the cavity C2, the seal J2 insulates the cavity C2 from the cavity C3, the seal J3 insulates the cavity C3 from the ambient atmosphere; and wherein at least one means M1 integrated in the mask, allows regulation of the desired pressure P1 in the cavity C1;

at least one means M2 allows regulation of the pressure P2 in the cavity C2;

at least one means M3 allows to regulation of the pressure P2 in the cavity C3; and wherein Generally, the pressure P1 is higher than the pressure P2;

Generally, the pressure P2 is higher than the pressure P3; and wherein the pressure P2 regulated by the means M2 is a continuous and increasing function of the pressure P1, so that the pressure P2 will, most of the time, be lower than the pressure P1 and that the pressure P2 will generally have an intermediate value between the pressure P1 and the pressure P3; and wherein on every part of the seal J1, the differential pressure prevailing on each side of the seal is equal to $\Delta P1 = P1 - P2$; and wherein on every part of the seal J2, the differential pressure prevailing on each side of the seal is equal to $\Delta P2 = P3 - P2$; and wherein The seal J2 is placed so that it creates a strain on the skin of the cheeks in contact with the seal J1.

According to an advantageous process, a controllable passage-way between cavities C1, C2 and C3 is provided to permit a controllable gas flow thereby allowing the ventilation of the whole head.

According to an advantageous process, means for opening 10 are provided to permit breaking of the ties which keep the face system of the head protection system including at least a mask M and the rest of the head protection system on the wearer.

According to an advantageous process, automatic means 11 trigger on, at least partially, with the contact of water, the opening of the face part including at least a mask M.

According to an advantageous process, at least one of the two controllable flow paths are holes of variable diameter in relation to the pressure P1 so that the ventilation air flow be appreciably constant whatever the value of the pressure P1.

According to an advantageous process, at least one of the controllable flow paths includes a hole of variable section 9 adjustable by the wearer.

According to an advantageous process, the means M3 can be regulated by the wearer so that the pressure P3 is adjustable by the wearer.

BRIEF DESCRIPTION OF THE PREFERRED EMBODIMENTS

The invention will be better understood by the description detailed by an embodiment illustrated in the appended drawings, which respectively represent:

FIG. 4 represents the examples of pressure evolution P1, P2 and P3 as a function of PA pressure.

DETAILED DESCRIPTION OF THE PREFERRED EMBODIMENTS

Figure 1:
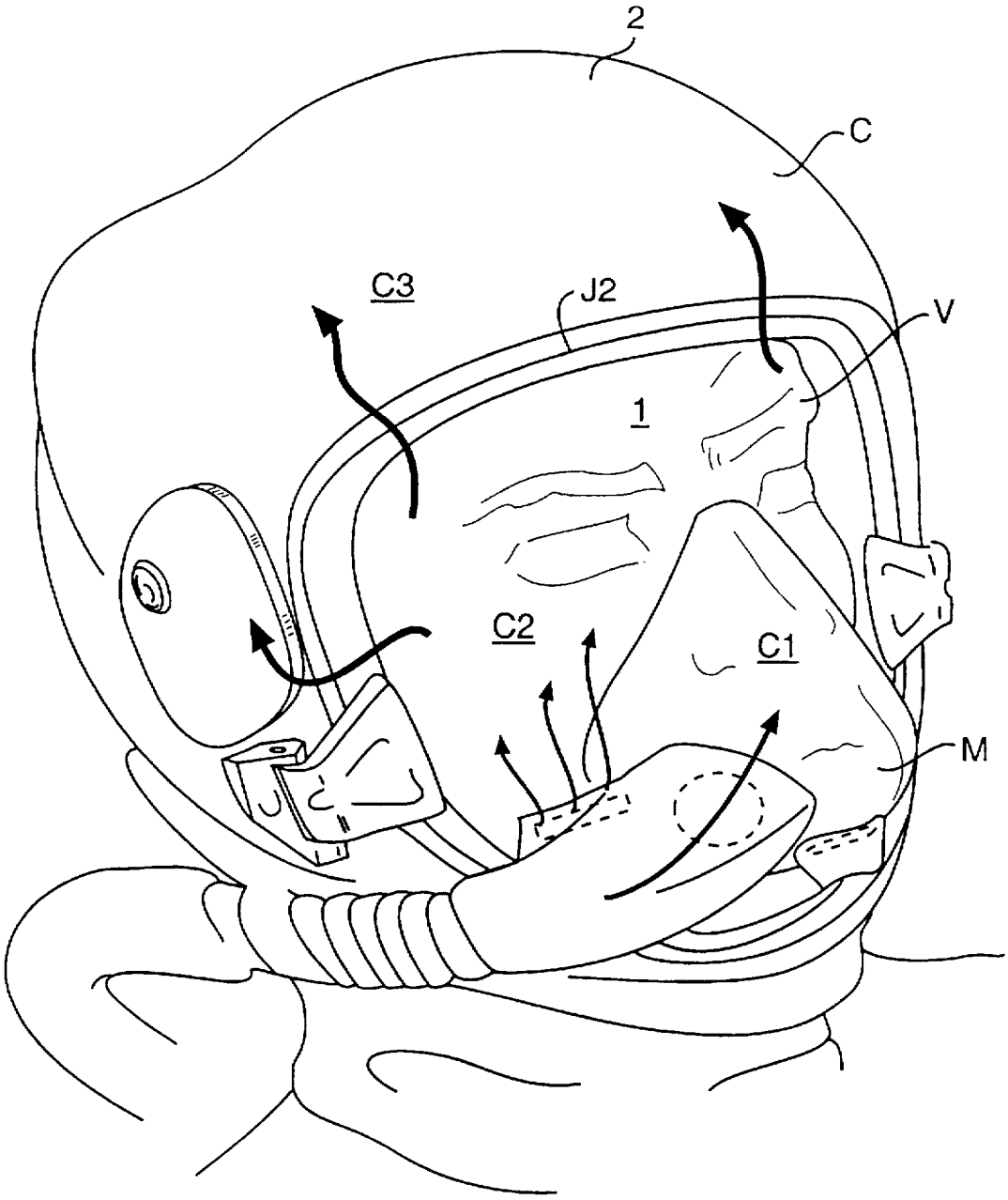
FIG. 1 represents a head protection system including a mask (M) integrated in a visor (V), the visor being an integrated part of the helmet (C)
Figure 2:
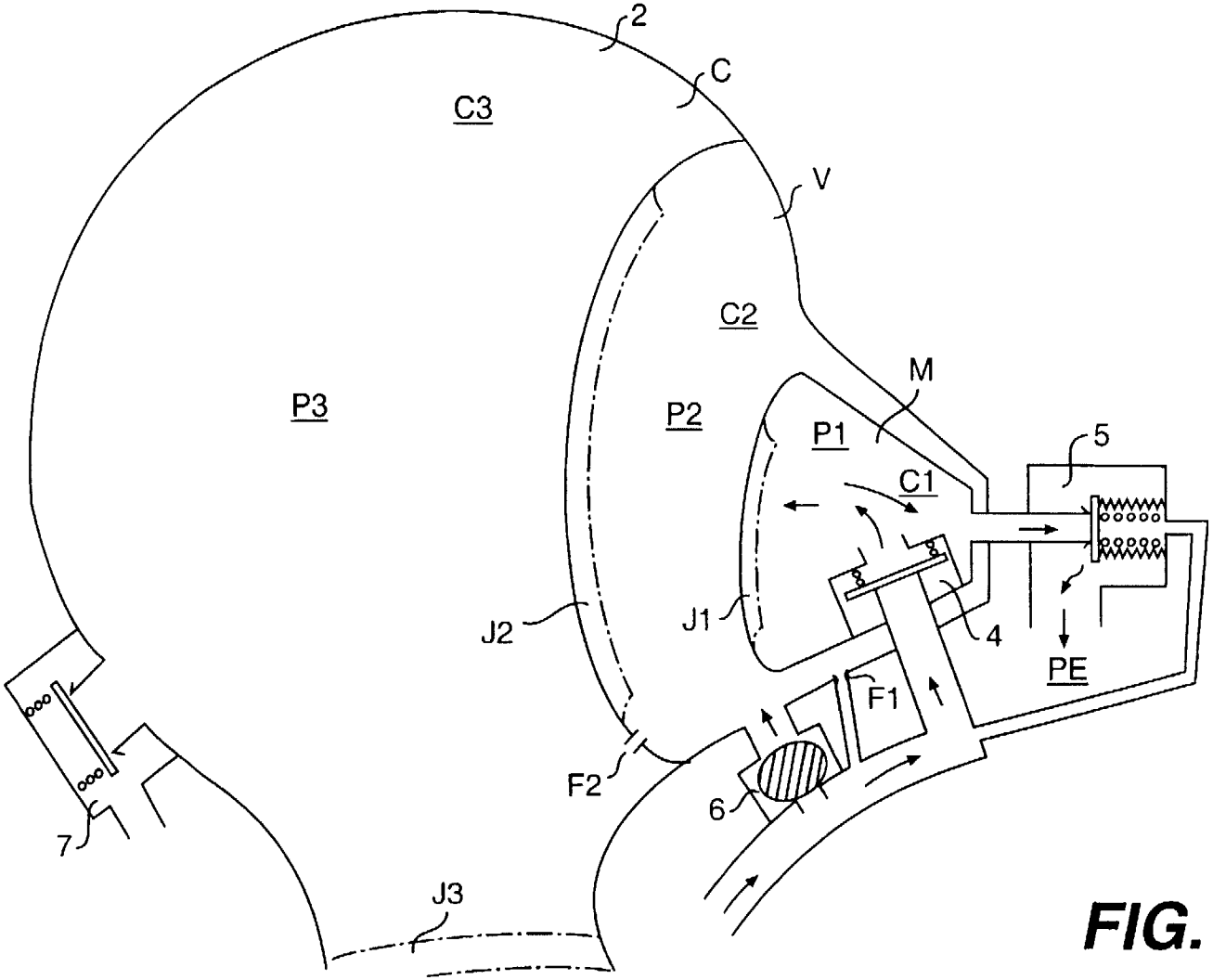
FIG. 2 represents a vertical cross-section passing about the head center and showing systematically a simple solution for regulation of pressures P1, P2, P3.

The detailed description of a process refers to FIGS. 1 and 2.

A wearer 1 is placed inside a head protection system 2. This head protection system 2 is composed of a helmet C, a transparent visor V on a level with the eyes and a mask covering the mouth and the nose. The mask, once set in position on the wearer's face, defines a cavity C1. The frontal part of a head component part, including at least the eyes defines a cavity C2. A seal J1 insulates the cavity C1 from the cavity C2. This seal J1 is continuous and completely integrated in the cavity C2, so that the pressure P1 prevailing in the cavity C1 is insulated from the pressure P2 prevailing in the cavity C2 because of the seal J1. These two pressures P1 and P2 exist around the entire periphery of the seal J1 which is continuous and which closes up on itself.

A helmet C surrounds the rest of the wearer's head. The cavity C3 is formed by the space between the helmet C, the head of the carrier, the seal J2 and the neck seal J3. The pressure prevailing in this cavity is equal to P3. The seal J2 is continuous and closes up on itself. This seal insulates the cavity C2 from the cavity C3. The seal J3 is continuous and closes up on itself. This seal insulates the cavity C3 from the ambient atmosphere. The hose 3 leads the breathable air under a pressure PA. An inspiratory valve 4 with very low capacity losses allows the passage in one direction of the breathable gas. The volume C1 is minimized to reduce the dead volume of the mask and to improve the $CO_2$ flow outside the mask. A compensated expiratory valve 5 allows expiration in an environment (which is at the pressure PE) whatever the inlet pressure PA.

Figure 3:
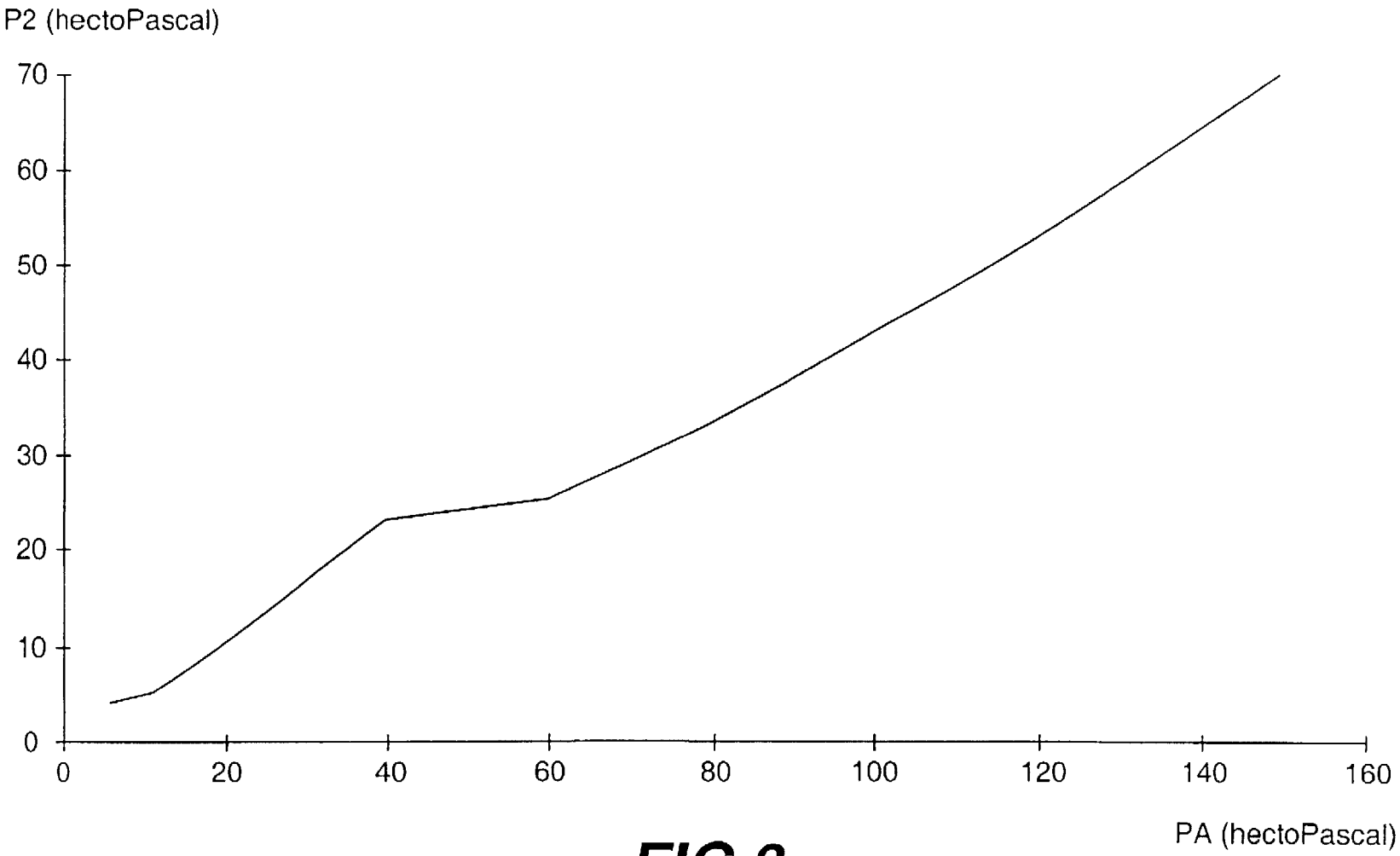
FIG. 3 represents a value example of pressure regulation P2 as a function of the pressure PA.

A mechanical or electrical pressure regulator 6 regulates the pressure P2 as a function of the pressure PA which is nearly equal to P1, in accordance with, for example the relationship defined in FIG. 3.

A controllable flow path F1 allows a small amount of flow to pass in order to ventilate, to cool the face and to remove the steam on the visor.

A controllable flow path F2 allows a little flow to pass into the cavity C3 in order to ventilate the head.

A valve 7 permits maintenance of a light pressure P3 in the cavity C3. For a typical aeronautical application, the chart of FIG. 4 gives an example of pressures which could be chosen.

The disposition chosen in this particular case permits the maintenance of a pressure in the mask, for example of 145 hectoPascal, by having a mask seal J1 which is not exposed to a differential pressure P1=145−70 so that in the case of FIG. 4 it is P1=75 hectoPascal. This mask seal can also be constructed with available materials and technologies. On the other hand, the seal J2 is submitted to a difference of pressure equal to P2−P3, in the chosen case, of FIG. 4 it is 70−5=65 hectoPascal. We can also see that the seal J2 is pulling skin of the cheek backward, which increases the cheek strain and improves the sealing features of the mask seal J1.

Certain mask parts of the visor and/or of the helmet can be common without the concept, nor the performance of the system being changed. The reader will easily understand that many adaptations of this concept can be easily performed. There are also many applications, when it is desirable to insulate the head from the ambient atmosphere in optimal manner.

What is claimed is:

1. A head protection system for providing certain types of physiological head protection in a contaminated atmosphere and at a low oxygen concentration, wherein the head protection system comprises a mask, a front face, a helmet portion, a first cavity defined by the mask for including the mouth and nose of the wearer, a breathable air inlet which admits breathable air under pressure to said first cavity, a second cavity defined by the front face of the head protection system for including the eyes of the wearer, a third cavity defined by the helmet portion of the head protection system for including a large part of the head of the wearer, said head protection system further comprising:

three continuous seals which close up on themselves, the first seal insulating the first cavity from the second cavity, the second seal insulating the second cavity from the third cavity and the third seal insulating the third cavity from ambient atmosphere;

at least one regulating means integrated in the mask for regulating a pressure in the first cavity;

at least one regulating means for regulating pressure in the third cavity such that the pressure therein is regulated as a continuous and increasing function of the pressure in the breathable air inlet and is generally lower than the pressure in the first cavity;

at least one regulating means for regulating a pressure in the third cavity such that the pressure therein is generally lower than the pressure in the second cavity; and wherein:

a differential pressure prevailing on each side of the first seal is equal to a pressure in the first cavity less the pressure in the second cavity;

a differential pressure prevailing on each side of the second seal is equal to a pressure in the third cavity less the pressure in the second cavity; and the second seal is positioned in the head protection system such that when the system is worn, the second seal creates a strain on the skin of the cheeks in contact with the first seal.

2. A head protection system as claimed in claim 1 wherein the means regulating the pressure in the third cavity is adjustable by the wearer of the system.

3. A head protection system as claimed in 1 further comprising an opening means which permits opening of ties which hold the portion of the head protection system including at least the mask over the face.

4. A head protection system as claimed in claim 3 wherein the means regulating the pressure in the third cavity is adjustable by the wearer of the system.

5. A head protection system as claimed in claim 3 wherein an automatic means causes at least partial opening of the portion of the head protection system over the face including at least the mask when the head protection system contacts water.

6. A head protection system as claimed in claim 5 wherein the means regulating the pressure in the third cavity is adjustable by the wearer of the system.

7. A head protection system as claimed in claim 1 further comprising at least two controllable flow paths, the first located between the first and second cavities and the second located between the second and third cavities, said controllable flow paths permitting ventilation of the entire head.

8. A head protection system as claimed in claim 7 wherein the means regulating the pressure in the third cavity is adjustable by the wearer of the system.

9. A head protection system as claimed in claim 7 wherein at least one of the two controllable flow paths is formed by holes whose diameter may be varied as a function of the pressure in the first cavity so that the ventilation flow in the at least one controllable flow path can be maintained substantially constant whatever the value of the pressure in the first cavity.

10. A head protection system as claimed in claim 9 wherein the means regulating the pressure in the third cavity is adjustable by the wearer of the system.

11. A head protection system as claimed in claim 7 wherein at least one of the controllable flow paths includes a hole whose diameter may be varied by the wearer of the system.

12. A head protection system as claimed in claim 11 wherein the means regulating the pressure in the third cavity is adjustable by the wearer of the system.

13. A head protection system as claimed in claim 7 further comprising an opening means which permits opening of ties which hold the portion of the head protection system including at least the mask over the face.

14. A head protection system as claimed in claim 13 wherein the means regulating the pressure in the third cavity is adjustable by the wearer of the system.

15. A head protection system as claimed in claim 13 wherein an automatic means causes at least partial opening of the portion of the head protection system over the face including at least the mask when the head protection system contacts water.

16. A head protection system as claimed in claim 15 wherein the means regulating the pressure in the third cavity is adjustable by the wearer of the system.

* * * * *

UNITED STATES PATENT AND TRADEMARK OFFICE

CERTIFICATE OF CORRECTION

PATENT NO. : 5,794,260

DATED : August 18, 1998

INVENTOR(S) : Schegerin, Robert

It is certified that error appears in the above-identified patent and that said Letters Patent is hereby corrected as shown below:

Column 4, line 32, change "third" to --second--.

line 44, change "third" to --second--;

line 45, change "second" to --third--.

Signed and Sealed this

Twenty-first Day of September, 1999

*Attest:*

Q. TODD DICKINSON

*Attesting Officer*

*Acting Commissioner of Patents and Trademarks*